United States Patent [19]

Santilli et al.

[11] B 3,989,971

[45] Nov. 2, 1976

[54] GATEABLE ELECTRON IMAGE INTENSIFIER

[75] Inventors: Vincent J. Santilli, Corning, N.Y.; James Vine, Pittsburgh, Pa.

[73] Assignee: Westinghouse Electric Corporation, Pittsburgh, Pa.

[22] Filed: Oct. 29, 1974

[21] Appl. No.: 518,859

[44] Published under the second Trial Voluntary Protest Program on February 3, 1976 as document No. B 518,859.

[52] U.S. Cl. ..... 313/99; 313/102

[51] Int. Cl.[2] ..... H01J 39/04; H01J 39/02

[58] Field of Search ..... 313/94, 102, 99

[56] References Cited

UNITED STATES PATENTS

| | | | |
|---|---|---|---|
| 2,994,798 | 8/1961 | Krieger et al. | 313/102 |
| 3,082,342 | 3/1963 | Pietri | 313/94 X |
| 3,280,356 | 10/1966 | Stoudenheimer et al. | 313/94 X |
| 3,475,076 | 10/1969 | Nelson | 313/94 X |
| 3,801,849 | 4/1974 | Edgecumbe | 313/102 |

*Primary Examiner*—Robert Segal
*Attorney, Agent, or Firm*—W. G. Sutcliff

[57] ABSTRACT

An electron image intensifier includes an input image means having a curved photocathode surface for converting the optical image to an electron image. The electron image is imaged upon an output image means spaced from the input image means, with an annular accelerating anode positioned between for accelerating the electrons to produce the image intensification. An annular gateable electrode is disposed between the input image means and the accelerating anode. The gateable electrode is structured and positioned with an inwardly disposed end portion closely spaced from the perimeter edge of the photocathode surface, and extending along the radius of curvature of the photocathode surface. The structure substantially eliminates any distortion from the gating electrode.

7 Claims, 2 Drawing Figures

GATEABLE ELECTRON IMAGE INTENSIFIER

BACKGROUND OF THE INVENTION

The present invention relates to an electron imaging device, and more particularly to an improved gateable intensifier tube, or electronic image devices such as electron bombarded camera tubes.

An image intensifier is an electron device which produces an observable image and is brighter at output than the optical image at the input. The image intensifier converts an optical input image to an electron image, and back to an optical image while intensifying the original image. Image intensifiers are typically used as night vision devices, or in other low light level applications, such as low light level television camera tubes. The intensification of the image is achieved by typically accelerating the electrons, which are a representation of the optical image, by applying a very high voltage to an accelerating anode. The electrons imaged upon the output means have increased energy in the form of kinetic energy. These high energy electrons typically impact a phosphor screen at the output means to produce photons which exceed the number of electrons which were initially released from the photocathode surface at the input means. This brings about a luminous gain or a light amplification. An image intensifier tube is a hermetically sealed evacuated device, typically having fiber optic input faceplate with a photoelectric layer deposited on the interior surface of the input faceplate. The optical input information generates the release of electrons from this photoelectric layer, and these electrons are accelerated and focused by the device.

In some situations it is desirable to be able to gate the operation of such image intensifier tubes. A gated tube is a tube having a control electrode with the appropriate potential for electrically controlling the operation of the tube, typically in an on-off fashion, and to thereby electronically shutter the equivalent optical information. The control electrode is typically synchronized with the switching on of the tube with some external auxiliary circuitry. The external circuitry may be utilized to drive an illuminating light source, which may be pulsed to provide reflected light for viewing the scene under consideration. It may be also desirable to gate the operation of the electron image intensifier to permit selective viewing of the scene, for example if a high light intensity source should pass into the field of view, it may be desirable to gate the image intensifier to prevent the undesirable image persistence and obliteration of the scene which may be produced by such a high intensity source. One common present technique for gating such electron image intensifier tubes is to utilize a fine conductive mesh spaced proximate to the photocathode surface. The mesh is operated at a relatively low potential difference from the photocathode but at high absolute negative potential. Such mesh electrodes are a distorting influence upon the imaging process, because of the physical disposition of the mesh between the input image means and the output image means. The mesh is also typically fixed in place and produces a further distortion problem when the device is operated in the non-gated mode, that is when the mesh is maintained at the same potential as the photocathode surface. Such mesh gated image intensifier tubes are also objectionable because of the relatively high gate voltage required for operation, usually about 10% of the anode voltage. The output image is deteriorated as a result of the excessive noise during the gating operation when such large gating voltages are used. The typical anode voltages in such tubes range from 12 to 15 kilovolts, and thus, the gate voltage required is about 1200 to 1500 volts. With gate voltages in this range it is also very difficult to effect rapid switching from the non-gated to the gated mode of operation, and for accurate rapid synchronization of the gated operation with auxiliary systems.

Other electronic imaging tubes have similar input and output imaging means, with the output target being an array of diodes. This type of device is termed an electron bombarded camera tube. It is also desirable to be able to gate such devices while avoiding the inherent problem of using the standard mesh gate.

SUMMARY OF THE INVENTION

The present invention relates a gated electron intensifier tube which is specifically tailored for rapid gating operation without loss of high quality performance. The electron-optic design provides a relatively low voltage gating operation, with a substantially undistorted operation in either a gated or non-gated mode. The electron image intensifier tube of the present invention comprises a hermetically sealed envelope having a spaced input and output image means. The input image means includes a curved photocathode surface on the interior of the tube. An annular accelerating anode is positioned within the tube envelope between the input and output imaging means for accelerating electrons to produce the image intensification. An annular gateable electrode is disposed within the tube, between the input image means and the accelerating anode. The gateable electrode includes an inwardly disposed end portion proximate to but spaced from the perimeter of the photocathode surface. The gateable electrode end portion extends along the radius of curvature of the photocathode surface. The length of the gate electrode portion extending along the radius of curvature of the photocathode surface is selected to be long enough to effectively gate the operating voltage, but is not long enough to distort the imaging operating.

DESCRIPTION OF THE PREFERRED EMBODIMENT

Figure 1:
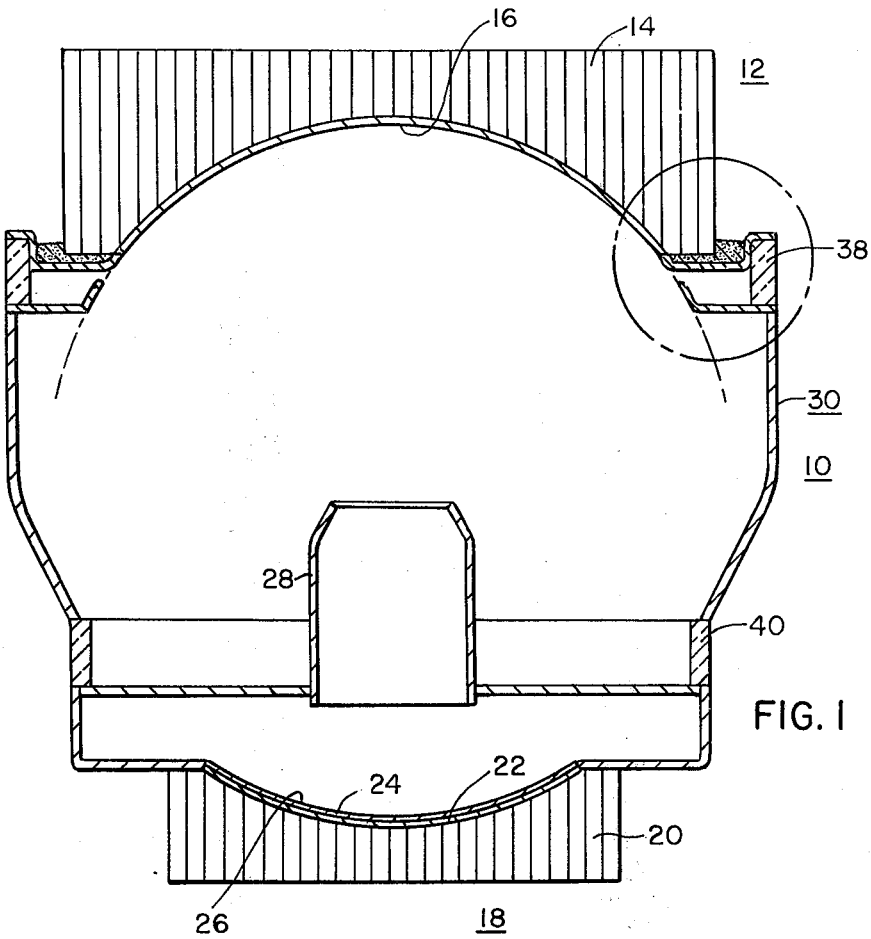
FIG. 1 is a simplified cross sectional representation of the image intensifier tube of present invention It also represents the image section of a typical camera tube or similar device.

The invention can be best understood in reference to the exemplary embodiment which is an image intensifier. In FIG. 1, the image intensifier tube 10 is a hermetically sealed device which is evacuated. The image intensifier tube 10 comprises an optical input image means 12, which includes a light transmissive fiber optic faceplate 14. The interior surface of the faceplate 14 is curved with a predetermined radius of curvature. The photocathode layer 16 which is disposed upon the interior surface of the faceplate 14, is typically formed of an S-20 tri-alkali photoelectric material, which has a broad spectral sensitivity. An output image means 18 is disposed at the other end of the generally tubular intensifier tube spaced from the input image means 12. The output image means 18 also comprises typically a fiber optic output faceplate 20, which has a curved interior surface which is in the image plane of the device. The curved interior surface 22 of the output faceplate 20 has a phosphor layer 24 disposed thereon. A thin electron transmissive aluminum film layer 26 is disposed atop the phosphor layer film 24.

A generally annular accelerating anode 28 is disposed within the intensifier tube 10 about the longitudinal axis passing through the input faceplate and the output faceplate. The anode 28 is generally closely spaced from the output image means. A relatively high operation voltage, for example 15,000 volts, is applied to the anode to effect the image intensification. A gate and focus electrode 30 which is also generally annular, as shown in FIG. 1, comprises the intermediate envelope portion between the input image means 12 and the output image means 18. The generally annular gate electrode 30 compriese the elongated generally tubular portion 32 which extends from proximate the input image means beyond the anode electrode 28. The gate electrode 30 has an inwardly disposed end portion 34 proximate the input image means 12, with a terminating end portion 36 which is closely spaced from the perimeter portion of the photocathode. The terminating end portion 36 is disposed along the radius of the photocathode surface 16. The insulating means 38 and 40 at opposite ends of the gate electrode 30 serve to insulate this electrode 30. The insulators are typically ceramic, and a ceramic to metal seal is effected to hermetically seal the device. A conductive lead-in 35 makes electrical contact with the photocathode layer 16. The lead-in 35 is sealed on one side to the ceramic insulator 38, and the other side of lead-in 35 is sealed by frit glass 37 to the input faceplate 14.

Figure 2:
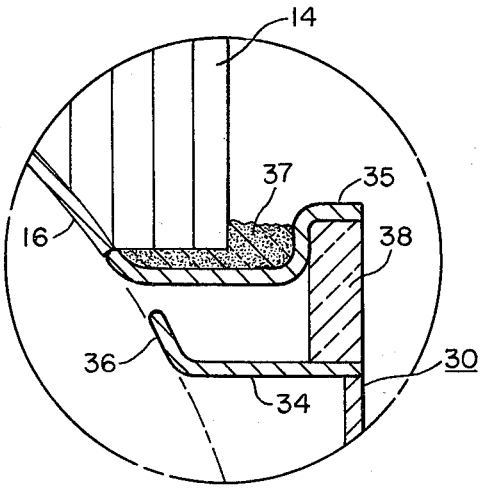
FIG. 2 is an enlarged partial view of the tube portion indicated in FIG. 1 showing the physical relationship of the extending end portion of the gate electrode relative to the photocathode surface.

The physical relationship of the terminal end portion 36 of the gate electrode 30 to the photocathode surface of the layer 16, is shown in greater detail in FIG. 2. From this figure, another functional advantage of the present design can also be appreciated. In the fabrication process of such an image intensifier tube the input image means fiber optic plate is typically sealed to the insulator 38 and the electrode means 30 is likewise sealed to the insulator 38 via a conventional ceramic to metal seal. The tri-alkali photoelectric materials are introduced through a temporary tubulation into the sealed tube, and is evaporated for deposition onto the interior surface of the faceplate 14. This evaporation deposition process is conducted along a line of sight that is typical for such deposition processes. The physical configuration of the terminal end portion 36 of the gate electrode 30 is such that it prevents deposition of the photoelectric material upon the insulator means 38. The photoelectric material is a conductive material, and any such deposition upon the insulation 38 would provide an electrical connection between the photocathode layer and the gate electrode. This would negate the capability of operating the gate electrode at a separate potential.

For a typical image intensifier tube, the distance along the longitudinal axis between the center of the input faceplate and the curved output faceplate is typically about 5.1 inches. The spacing between the interior surface of the input image means and the end of the anode is typically about 2.46 inches. The radius of the curved interior surface of the image means is about 0.95 inches, and the radius of curvature of the surface is about 2.4 inches. The length of the inwardly extending end 34 of the gate electrode 30 is about 0.5 inches, and the length of the terminal end portion 36 is about 0.056 inches. The spacing between the end of the terminal end portion 36 and the perimeter of the photocathode surface is about 0.050 inches. For the image intensifier described above, the magnification factor is 0.617 at a gate voltage of only 4.75% of the anode voltage instead of the 10% of anode voltage required for a mesh gate electrode. The image resolution is about 47 lines per millimeter. The gate voltage is applied to the gate electrode 30 when it is desired to gate the device for normal diode-type operation.

The photocathode surface and the gate electrode can be conveniently electrically connected external of the tube for zero focus operation when the gate potential is removed. The positioning and geometry of the gate electrode are such as to effectively gate at a relatively low voltage which permits noise free operation, while minimizing distortion for zero focus normal operation. The tube is easily fabricated and has a high resolution because of the elimination of any physical mesh in the electron path.

The output image means 18 can be a diode array target, such as described in U.S. Pat. No. 3,821,092, or other such diode array target.

We claim:

1. An electronic imaging tube comprising:

a hermetically sealed envelope;

an input image means including a curved photocathode surface;

output image means spaced from the input image means;

an annular accelerating anode positioned within said envelope between the input and output means for accelerating electrons to produce image intensification;

an annular gateable electrode disposed within said envelope between the input means and the anode, which gateable electrode includes an inwardly disposed end portion proximate to but spaced from the perimeter of the photocathode surface, which end portion extends along the radius of curvature of the photocathode surface.

2. The electronic imaging tube specified in claim 1, wherein the input image means includes a fiber optic faceplate.

3. The electronic imaging tube specified in claim 1, wherein the output image means includes a fiber optic output faceplate.

4. The electronic imaging tube specified in claim 1, wherein the output image means includes a phosphor layer disposed on the interior surface of a light transmissive output window with a thin electron transmissive aluminum reflective film layer disposed over the phosphor layer.

5. The electronic imaging tube specified in claim 1, wherein insulating envelope means electrically insulates the annular gateable electrode from the photocathode surface to permit gating operation of the tube by application of a potential difference between the gateable electrode and the photocathode surface, while permitting electrical connection of the gateable electrode to the photocathode surface external of the tube for non-gated operation.

6. The electronic imaging tube specified in claim 1, wherein the annular gateable electrode extends about the tube longitudinal axis passing through the input and output image means, which gateable electrode extends for a substantial portion of the distance between the input and output image means.

7. An electronic imaging tube comprising:

a hermetically sealed generally tubular envelope;

an input image envelope portion comprising a fiber optic faceplate with a curved interior surface having a photocathode surface layer disposed thereon;

an output imaging envelope portion spaced from said input image envelope portion;

an annular accelerating anode disposed within said envelope about the tube longitudinal axis passing through the input and output envelope portions, which anode is disposed between the input and output envelope portions;

an annular gateable electrode which forms a portion of the envelope wall extending from proximate the input window to the output window with insulating envelope portions disposed between the ends of the gateable electrode envelope wall portion and the input and output envelope portions, and which annular gateable electrode has an inwardly extending portion proximate to but spaced from the photocathode curved surface, which extending portion extends along the radius of curvature of the photocathode surface layer.

* * * * *